United States Patent [19]

Levinson et al.

[11] 4,029,007

[45] June 14, 1977

[54] AUTOMATIC DATE-STAMPING SYSTEM FOR VEHICLES ENTERING PARKING AREAS

[75] Inventors: Armand L. Levinson; Donald W. Heinerichs, both of Baltimore; George Ruck, Towson, all of Md.

[73] Assignee: Armand L. Levinson, Baltimore, Md.

[22] Filed: Oct. 24, 1975

[21] Appl. No.: 625,566

[52] U.S. Cl. ..... 101/42; 101/DIG. 3; 49/31; 49/49; 49/263; 194/DIG. 23

[51] Int. Cl.[2] ..... B41F 17/00

[58] Field of Search ..... 101/41–44, 101/35, 4, 233, 234, 239, 241, 242, DIG. 3; 214/16.1 R; 49/35, 49, 263, 31; 118/8, 2, 1; 194/DIG. 8, DIG. 23, DIG. 24; 235/92 TC

[56] References Cited

UNITED STATES PATENTS

| | | | |
|---|---|---|---|
| 1,369,934 | 3/1921 | Onstad | 101/44 UX |
| 2,588,502 | 3/1952 | Dunn | 194/DIG. 23 |
| 2,637,920 | 5/1953 | Stratton | 194/DIG. 23 |
| 2,735,202 | 2/1956 | King | 194/DIG. 23 |
| 2,795,875 | 6/1957 | Nutter et al. | 214/16.1 R UX |
| 3,080,813 | 3/1963 | Staub et al. | 101/43 |
| 3,589,280 | 6/1971 | Wilde | 101/35 |
| 3,688,690 | 9/1972 | Gabbrielli | 101/35 |

*Primary Examiner*—Clifford D. Crowder
*Attorney, Agent, or Firm*—Samuel Lebowitz

[57] ABSTRACT

An automatic date-stamping system for vehicles entering a parking area for a relatively long period of time, i.e., for more than one day rather than several hours, so that the accumulated charges of the parking costs at the time of leaving, are easily and reliably determinable. The date is stamped automatically on the sidewall of a tire of the vehicle in invisible ink, so as not to mar the appearance of the vehicle, before the blocking and/or signalling means are operated to permit entry of the vehicle into the parking area. Exposure of the date-imprint to ultra-violet light or other rays to which the printing ink is responsive, renders it visible for reading at the time of leaving the parking area, or before that time, if such is necessary.

15 Claims, 10 Drawing Figures

AUTOMATIC DATE-STAMPING SYSTEM FOR VEHICLES ENTERING PARKING AREAS

This invention relates to a date-stamping system for vehicles entering a parking area, to record the time of entry so that this information is readily available when the parking period is terminated.

It is the object of the present invention to provide a reliable recording system for toll-operated parking areas, especially when the period of parking is a long one, extending over several days, as is the case with parking lots or garages at airports, cruise-ship piers and the like, with the increased incidence of the loss of parking slips which renders impossible an accurate determination of the charges which have accrued for the parking privileges.

It is a further object of the invention to record automatically the date of entry of the vehicle into the parking area in an imperceptible or invisible way, without marring the vehicle or its components, but with such a degree of reliability that the date or time of entry is clearly apparent and readable, and this may be done by means of stamping the time of entry on the side-wall of a tire with invisible ink which becomes visible by the exposure thereof to light of special wave-lengths, such as ultra-violet, which renders the date markings clearly visible.

It is a further object of the invention to provide a reliable recording system which is universally adaptable to the marking of the tires of vehicles of different sizes and wheel-bases, and in which the entry of the vehicle into the parking area is blocked until the date is stamped upon the side-wall of a tire of the vehicle.

Other objects and purposes will appear from the detailed description of the invention following herein, taken in conjunction with the accompanying drawings, wherein FIG. 1 is a perspective view of a preferred embodiment of the invention;

Figure 1:
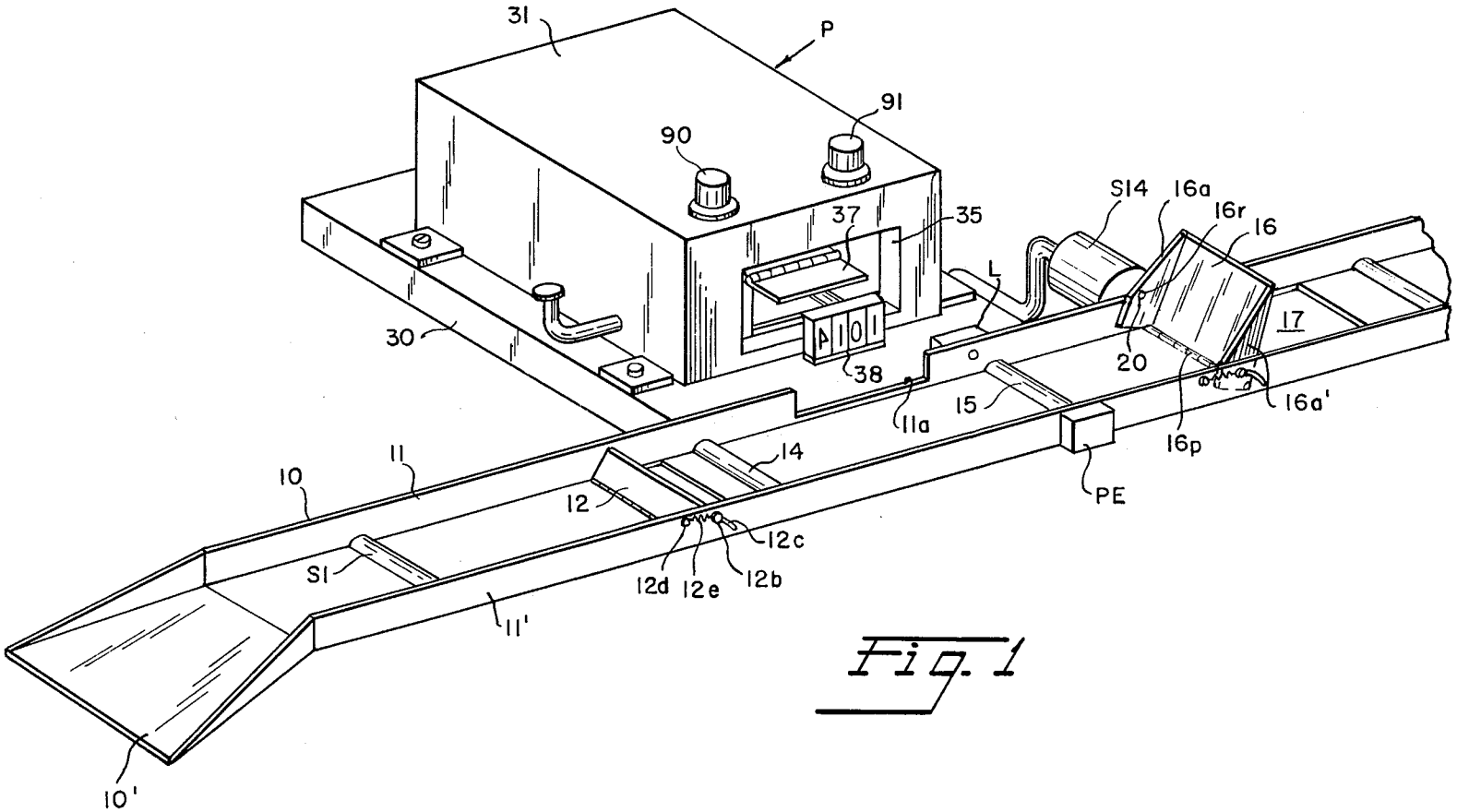

In the drawings, is shown a steel guide channel 10 embodying mechanical and electrical devices for cyclical operation, disposed on the side of a printing housing P, from which extends a reciprocable date-stamp 38 for automatic movement against the side-wall of a tire, to impress the date thereon in invisible ink, as fully described below in greater detail.

The steel guide channel 10 resembles supporting channels for vehicles in automobile servicing stations and is provided with a flared inlet 10' to facilitate the entry of the left front wheel of the vehicle into the guide channel and which is also fitted with upstanding restraining side walls 11,11'.

A suitably covered contact switch S1 is disposed across guide channel 10, which is operated momentarily upon the entry of the wheel into the channel, for initiating the circuit operation, described in greater detail hereinafter.

Figure 3:
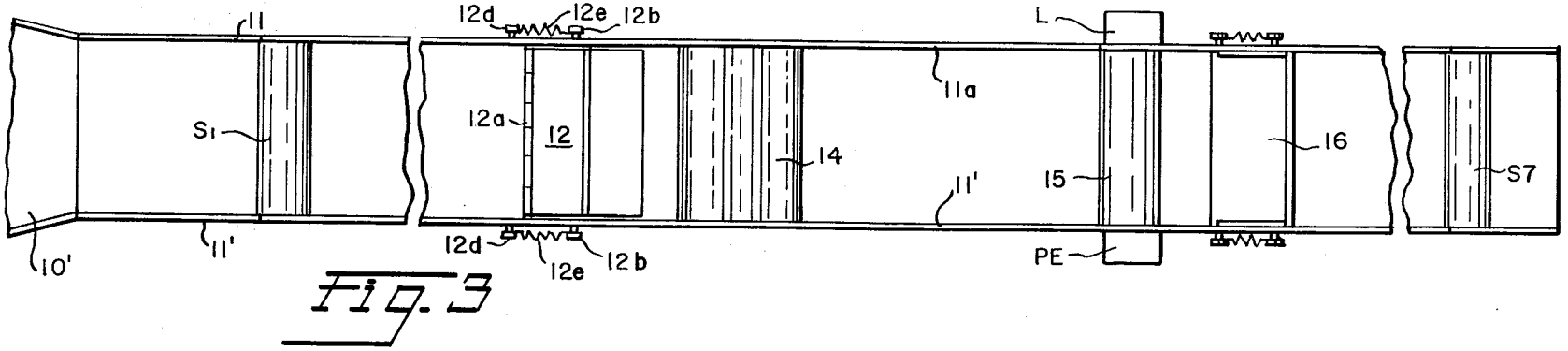
FIG. 3 is a plan view of the steel guide channel shown in FIG. 2.
Figure 2:
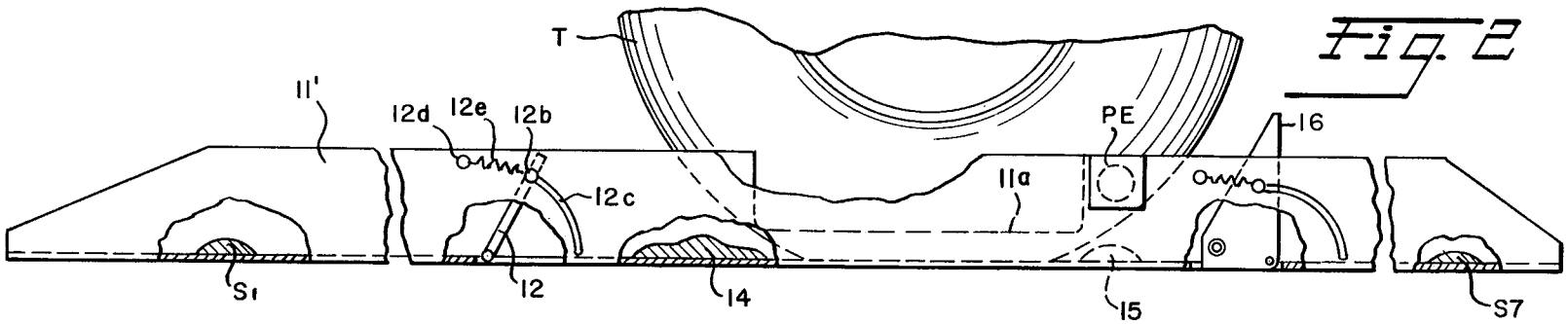
FIG. 2 is a side elevation of the steel channel, with portions broken away, for guiding the vehicle wheel in position to have the date of entry stamped on the side-wall of a tire thereon.

A pivoted blocking plate 12 is disposed on the floor of the channel, which is spring-biased to permit the passage of the wheel thereover, but which swings back into upstanding position following the travel of the wheel, to prevent backing up of the vehicle in the course of the operating cycle with the consequent damage to the components of the system and/or the faulty operation thereof. In FIGS. 2 and 3, is shown one way of mounting the pivoted block or plate 12 for rotary movement around its pivotal axis **12*a*. Lugs 12*b*, projecting from the opposite sides of plate 12 adjacent the free end thereof, extend through arcuate slots 12*c* in the walls 11,11', and springs 12*e* may be connected between these lugs and lugs 12*d* extending outwardly from the walls 11,11' to yieldingly retain plate 12 in upstanding position. The block 12 may be rocked in a clockwise direction and return in the reverse direction following the passage of the wheel thereover. Further movement in a counterclockwise direction is blocked by the engagement of lugs 12*b* with the upper ends of arcuate slots 12*c***.

As the wheel advances, it is stopped in its position for stamping by means of locating bumps 14 and 15 on the bottom of the guide channel, which brings the wheel adjacent to the notched recess **11*a* in the side 11 of the guide channel, and in the field of movement of the date-stamp 38**.

Also, the tire T is now in a position to block the light emanating from a light source L mounted on the outer face of wall 11 of the channel, through an opening therein, towards a photoelectric coil PE on the outside of the opposite wall 11' which controls a circuit including a reversible electric motor for actuating the date-stamping mechanism. The actuation of the latter is followed by the withdrawal of the locking bolt 20 from the blocking plate 16, so that upon the change of indication of the indication lights 90 and 91 on top of the housing 31, from a red to a green signal, the operator may advance the car over the blocking plate 16 for entry into the parking area.

The blocking plate 16 may be mounted for pivotal movement on the floor of the guide channel 10 in many different ways. Thus, an arrangement similar to that provided for the pivoting of the blocking plate 12 described above, with a lug movable in an arcuate slot, may be used, or alternatively a spiral spring may be employed on the pivot pintle which is normally biased to maintain the blocking plate 16 in an upstanding position, but which permits freedom of movement in a clockwise direction following the withdrawal of the locking bolt 20 extending transversely through an opening in the side-wall **16*a* of the blocking device 16**.

The inner lateral edge of the blocking plate 16 is provided with a side-wall 16*a'* of triangular outline, which is similar to the side-wall 16*a* on the outer side, the latter of which is provided with a recess 16*r* for receiving the locking bolt 20 in its extended position, forming part of, and controlled by, the solenoid S14, (FIG. 1). This solenoid is operated by cable connections thereto from the electro-mechanical logic module EML which is mounted on the base 30 in the housing 31 adjacent to the outer side of the steel guide channel 10.

The last element in the guide channel is a covered contact switch S7 which is operated momentarily by the rear wheel to re-set the parts in position for the entry of the next vehicle, as fully explained below.

Figure 5:
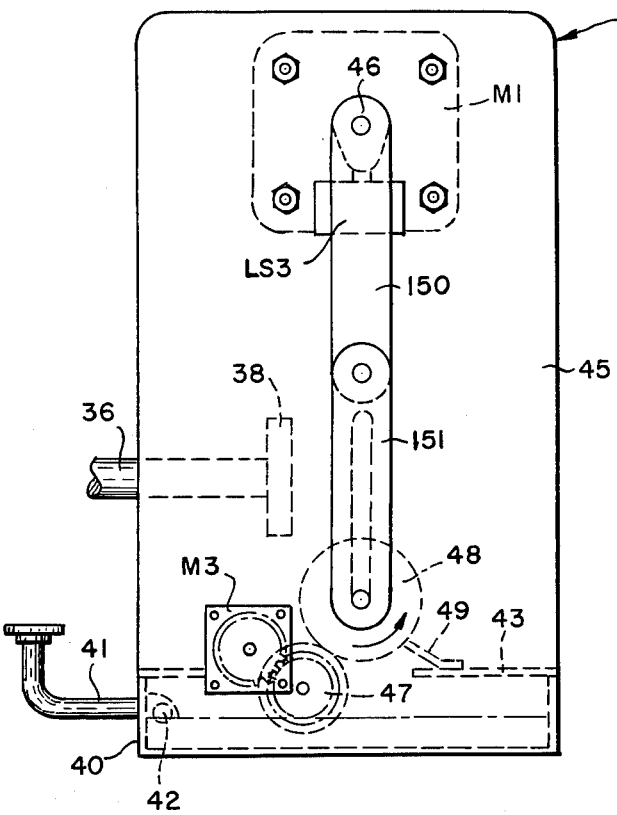
FIG. 5 is a side elevation of the inking mechanism within the printing assembly for applying automatically the invisible ink to the type face of the stamp.
Figure 6:
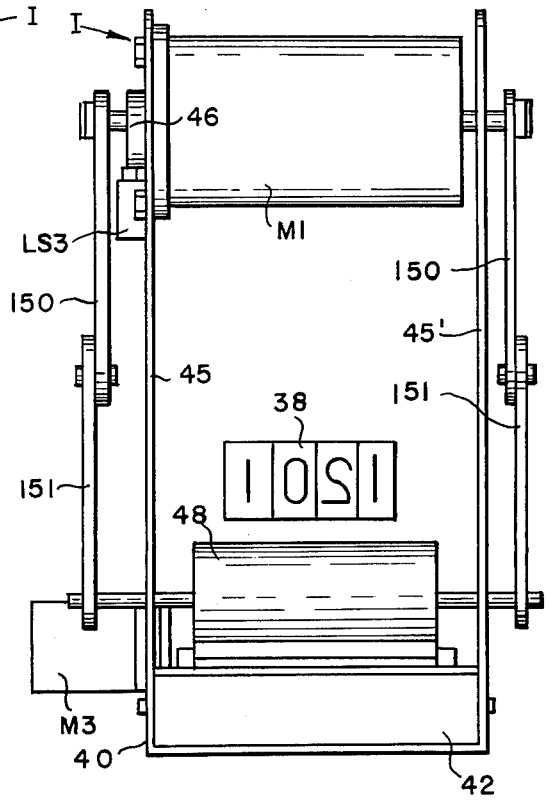
FIG. 6 is a right-end view of FIG. 5.

In FIGS. 5 and 6 is shown an arrangement making possible the repeated application of a coating of invisible ink to the face of the stamping mechanism, which is illustrative only, since many mechanisms in the prior art may be employed for the inking of the date stamp.

Figure 7:
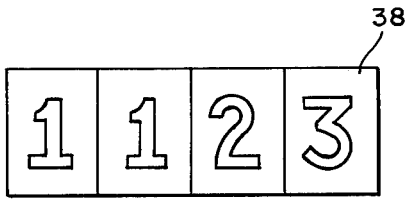
FIG. 7 is an enlarged view of the impression of the month and date made by the date stamp on the side-wall of the tire.

In the illustrated embodiment of the invention, the date may be changed manually at midnight every successive day, and as shown in FIG. 7, the stamp is set for operation on Nov. 23, while in FIG. 1, it is set for Oct. 14, and in FIG. 6, for Dec. 1. The date may be advanced automatically by a built-in clock mechanism as is well known in clock-operated recorders as disclosed in U.S. Pat. Nos. 2,019,301, Oct. 29, 1935, and 3,626,463, Dec. 7, 1971.

The inking mechanism I is disposed within the housing P, adjacent the opening 35. It consists essentially of an open frame formed of two side walls 45,45', at the base of which is provided a pan or reservoir 40 for the supply of ink, with an inlet pipe 41. The reservoir may be filled with an ink sensitive to ultra-violet light, which fluoresces when illuminated with black light of a wave length of approximately 3660 Angstrom units. The level of ink may be controlled by a ball float check valve 42, and evaporation of the ink therein is reduced by the provision of a cover 43. A continuously running motor M3 is mounted on the side 45 of the inking frame, and gearing between it and a roller 47 partially immersed in the bath of ink serves to stir the latter and apply ink uniformly to roller 48. The roller 47 is in rolling contact with the inking roll 48 which is mounted at the base of a slide lever system 50 and 51 extending between the rotary shaft of motor M1 mounted at the top of the frame. A wiper 49 is disposed on the top wall 43 of the ink reservoir to limit the amount of ink impregnated in the roller 48 preparatory to its upward movement when the same is brushed against the face of the date stamp 38.

The motor M1, rotating at a speed of approximately six revolutions per minute, requires 10 seconds for the completion of its stroke to raise the inking roller against the date stamp and to lower it following the application of the ink thereto. At the end of each revolution, a cam 46, mounted on the shaft of the motor, operates the limit switch LS3 to turn off motor M1 and to initiate the next stage of the operation, and particularly the reciprocating movement of the date stamp against the side wall of the tire.

Figure 9:
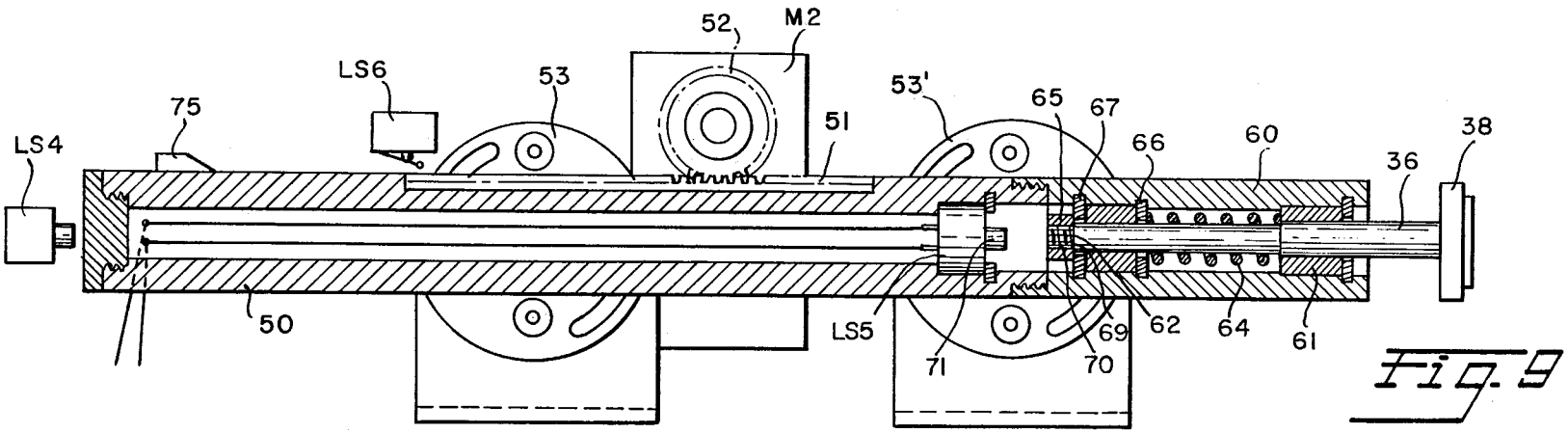
FIG. 9 is a sectional view of the reciprocating mechanism for the date stamp, with certain parts in elevation.
Figure 4:
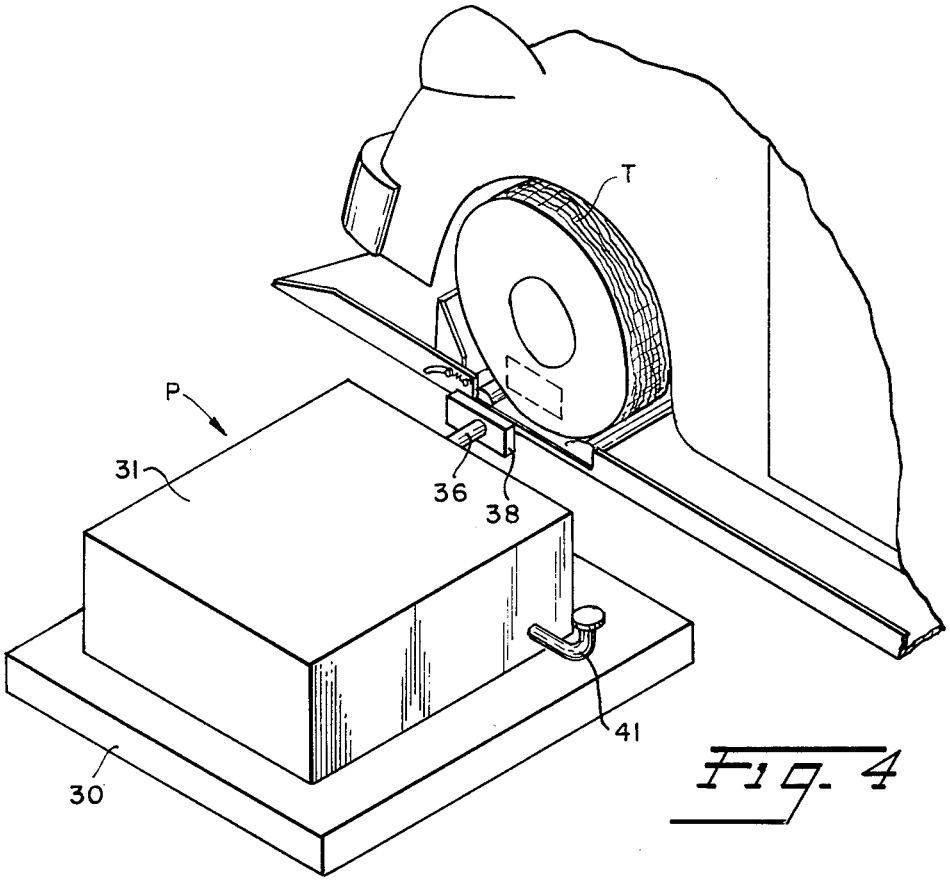
FIG. 4 is a perspective view of the vehicle in position for printing on the left front tire by the stamping mechanism.
Figure 8:
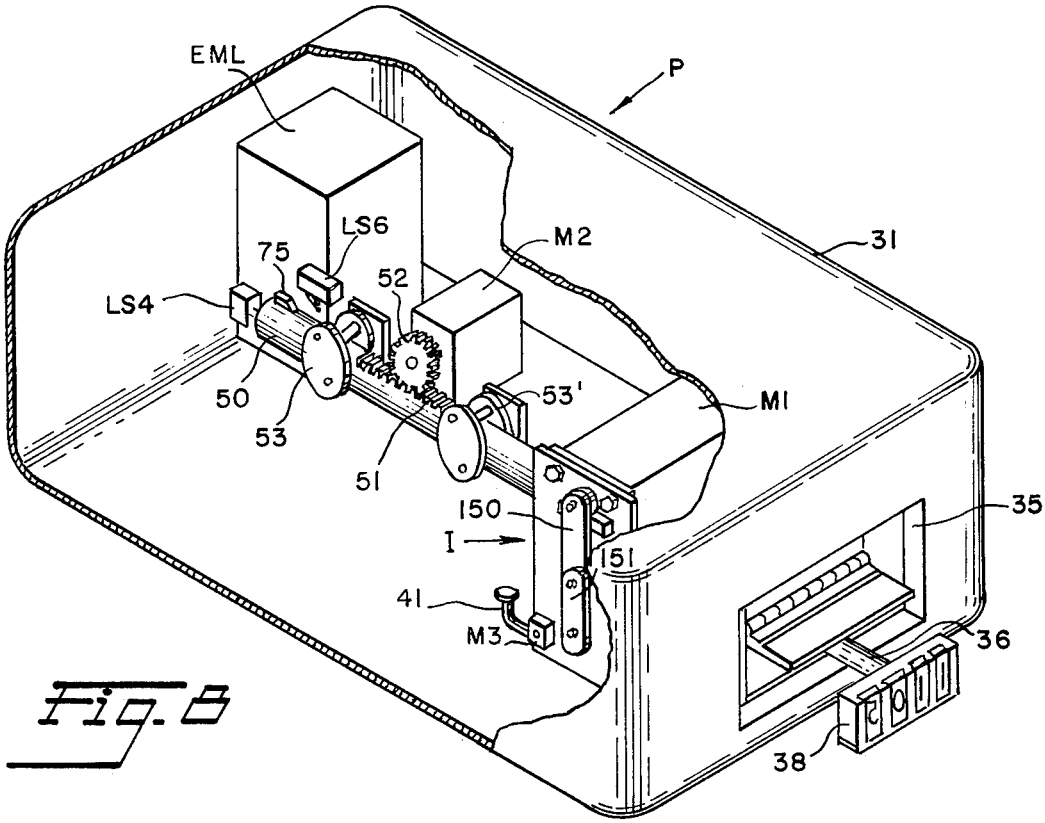
FIG. 8 is a perspective view of the interior of the printer housing with the devices therein showing generally the mechanisms for successively inking the date stamp, and automatically moving it relative to the side-wall of the tire.

In FIGS. 8 and 9 is shown the electromechanical driving mechanism for moving the date stamp against the side-wall of the tire and thereafter withdrawing it. This mechanism, which is operated by reversible motor M2, is housed in the casing 31 and serves to project the date stamp through the opening 35 in the housing which may be provided with a pivoted cover for completely enclosing both the inking mechanism and the actuating mechanism for the date stamp to protect them against the entry of dirt or dust. Hydraulic or pneumatic drives for effecting the reciprocating movement of the date stamp may be used as alternative actuators for the electromechanical drive shown in the illustrated embodiment.

The reversible motor M2 is provided with an external gear pinion 52 which meshes with a gear rack 51 on the top of hollow cylinder 50, which is guided for reciprocating movement within slide bearing elements 53 and 53' at displaced points of the housing 31. A supplemental hollow cylinder 60 is connected to the forward part of cylinder 50, in which is housed the cylindrical shaft 36 bearing the date stamp at its front end. Shaft 36 is yieldingly housed within cylinder 60, and is freely movable in the latter together with the enlargement at its inner end, afforded by nut 65.

Linear bearings 61 and 62 are fitted within the front and rear portions of the hollow cylinder 60 to facilitate the relative movement between the inner shaft 36 and outer cylinder 60, and a spiral spring 64 is disposed between the stepped portion of shaft 36 and the inner wall of cylinder 60. Spring 64 is confined between an annular stop 66 protruding into the bore of cylinder 60 and an intermediate shoulder on shaft 36. This spring 64 is compressed when shaft 36 is stopped by the obstruction of the side-wall of the tire, while the cylinder 60 is moved forwardly. The end 69, which is now stationary, operates limit switch LS5 to reverse the movement of the cylinders 50 and 60, and to permit the eventual partial withdrawal of shaft 36 from cylinder 60 by action of the compressed spring 64.

As stated above, when the date stamp 38 encounters the sidewall of the tire to stop the movement of the inner shaft 36, the outer cylinder 50 continues moving until the limit switch LS5 is actuated by contactor 71 encountering the inner end 69 of shaft 36. Approximately three pounds of force is applied to the vehicle tire during this stroke, and the actuation of the limit switch LS5 causes the driving motor M2 to reverse its rotation. This operates to reverse the cylinder 50 until the rear end thereof strikes limit switch LS4 to cause the stopping of the motor M2. The actuation of this limit switch also operates the above-mentioned solenoid S14, which withdraws the plunger 20 from the opening 16*r* in the blocking plate 16 to permit the forward advance of the vehicle. Also at this time the red indicator 90 is extinguished and the green indicator 91 is illuminated to signal the operator of the vehicle that he is free to drive the car forwardly.

The cylinder 50 cooperates with another limit switch LS6 by the provision of a lug 75 adjacent the rear end of the cylinder, which cooperates with a contactor of the last-mentioned limit switch and serves as a back-up limit switch in the event the cylinder 50 reaches its fully extended position without contacting the obstacle of the tire. This limit switch LS6 performs the same function as the limit switch LS5 which serves to reverse motor M2 to withdraw the date-stamp actuating mechanism into the housing.

The operation of the system as described above may be explained in conjunction with the electrical control circuit shown in FIG. 10 as follows:

When the front wheel of the vehicle travels into the channel 10, the momentary depression of the contact switch S1 initiates the operation of the system from the power source L1, which may be a conventional power line of 115 volts with a grounded line indicated by arrows, and with a main switch S. The closure of switch S1 serves to energize the winding of latching relay LR1 by way of conductor 101, the closed terminals of switch S1 and the winding of the latching relay LR1 to the grounded or neutral line. The closure of switch *s*1 applies voltage to the time-delay relay R2, (indicated by an iron core adjacent the winding), which, upon closure of its switch *s*2 energizes the winding of latching relay LR3. Switch *s*3 of the latter closes the circuit to the ink applicator motor M1 (FIGS. 5 and 6) for one cycle of operation, at the conclusion of which, the limit switch LS3 is operated by the cam 46 mounted on the shaft of motor M1, to close the contacts of the limit switch and thereby to energize the time-delay relay R4, and thereby unlatch relay LR3, which inactivates motor M1. (Switch *s*2 of the time-delay relay R2 must open prior to the completion of the one revolution of motor M1, in order to permit latching relay LR3 to unlatch, with the consequent opening of switch *s*3.)

The closing of the limit switch LS3 serves to conduct current through branch line 104 across its bridged terminals through line 105 to the closed circuit of the photoelectric cell PE which has been shifted from its "off" to "on" position by virtue of the interruption of the light beam from the light source L onto the photocell. This completes the circuit to the latching relay LR5, which, upon the closing of its switch *s*5 energizes time-delay relay R6 through line 101, branch line 106, switch *s*5, line 107 to winding and ground. The closure of switch *s*6 of the last-mentioned relay completes the circuit to the winding of latching relay LR7 from line 101 to ground, and the closure of switch *s*7 of the latter energizes reversible motor M2 from line 101, line 110, field windings, F1,F2 and condenser C in parallel with F2, switch 112 to ground. The completion of this circuit causes the pinion 52, mounted on the motor shaft, (FIGS. 8 and 9), to advance the inking cylinder 50 and the stamp 38 at the end thereof into printing engagement with the side-wall of the tire which is now positioned between the bumps 14 and 15. The movement of the stamp is arrested by the tire side-wall and remains stationary while the cylinder 50 continues its movement until the inner end of shaft 36 operates the contactor 71 of limit switch LS5. The switch 113 of the latter completes a circuit from branch line 122 to the winding of latching relay LR9 which, upon energization, shifts the switch 112 of the relay to the other terminal, so that condenser C is switched in parallel with field winding F1. Condenser C, bridged across the alternate terminals connected to the field windings F1 and F2, permits the rapid reversal of the motor M2. The reversible motor M2 (FIG. 8) withdraws the cylinder 50 until it strikes limit switch LS4 which completes a circuit to the energizing winding of time-delay relay R8, through branch line 122, the upper set of contacts of the limit switch, conductor 126, relay winding and ground. Switch *s*8 of relay R8 applies voltage momentarily to latching relay LR7 to deenergize motor M2. The lower set of contacts of the limit switch LS4 completes a circuit to the energizing winding of latching relay LR9 which re-sets the position of the switch 112 to its original condition for the operation of the reversible motor M2.

The upper contacts of limit switch LS4 also apply voltage to the time-delay relay R10 by way of conductor 136 which momentarily closes switch *s*10 to apply momentary voltage to the latching relay LR11 through branch line 138. The closure of the switch *s*11 of the latter, completes the circuit to the coil of solenoid S14 which controls the plunger 20 in engagement with the opening 16*r* in the side wall of the blocking plate 16, and, which upon withdrawal, permits the latter to pivot in a clockwise direction upon the forward movement of the wheel.

The vehicle operator is signalled that he may move forwardly by the extinguishment of the red lamp 90 and the illumination of the green lamp 91 on top of the housing 31. The circuits to these lamps are energized from branch line 140 to operate the relay R15 which disconnects the circuit to the red lamp 90 at switch *s*15 and to simultaneously complete the circuit to the green lamp 91. Upon the forward movement of the vehicle the contact switch S7 is depressed by the front tire, which energizes the latching relay LR13 from line 138, the bridged contacts of momentary contact switch S7, line 141, winding of the relay to ground. The movement of the switch *s*13 to its downward position exercizes no control.

The passage of the rear tire over the contact switch S1 adjacent to the inlet end, unlatches LR1 and readies the motor M1 of the inking mechanism for operation upon the entry of the next vehicle. As the rear tire breaks the beam of the photoelectric switch, voltage is applied to the energizing winding of latching relay LR5 to unlatch it, and to relay the system for the operation of the reversible motor M2 for the next vehicle. As the second tire passes over the contact switch S7 at the outlet of the guide channel, latching relay LR13 is unlatched and applies voltage to the energizing winding of relay R12 from line 100 and branch line 145. The consequent operation of switch *s*12 through line 138, line 142 and winding of latching relay LR11 serves to unlatch the latter. This removes voltage from the energizing winding of solenoid 14 as well as the winding of relay R15, the former of which operates plunger 20 to fix the gate in upstanding position, and the latter of which extinguishes the green lamp 91 and illuminates the red lamp 90. The system is now completely ready for the next vehicle.

The total elapsed time for the complete stamping operation may require no more than 15 to 25 seconds.

Figure 10:
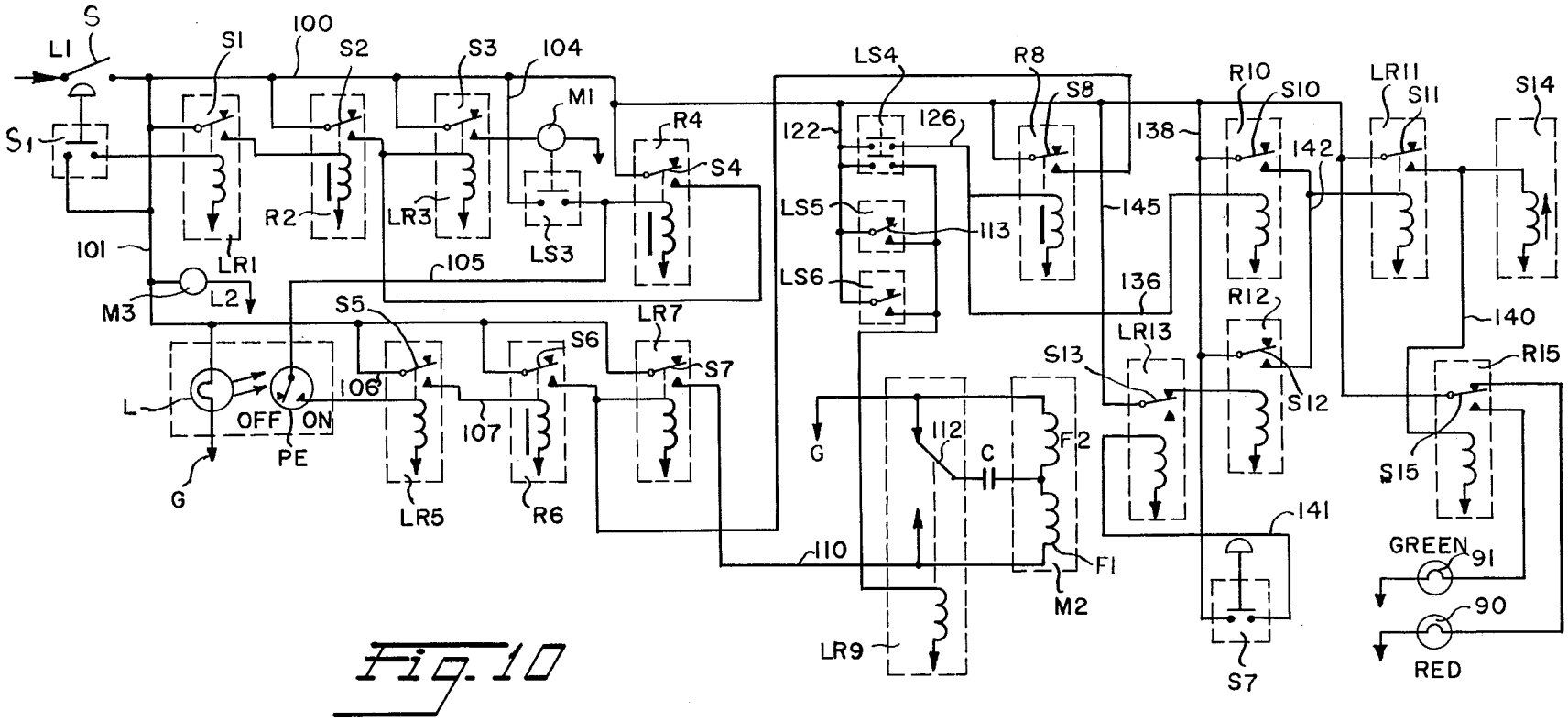
FIG. 10 is a preferred embodiment of a circuit diagram of the system for the automatic operation thereof.

As may be seen in FIG. 10, the inking motor M3 is energized continuously, so that the ink is maintained in a stirred condition.

The blocking means against the entry of the vehicle into the parking area may assume forms other than that in the embodiments shown and described herein, for example, a pivoted gate. Furthermore, the system disclosed herein may be used in conjunction with conventional ticket-issuing controls for entering parking areas, for example, as illustrated in U.S. Pat. No. 2,795,875, June 18, 1957.

We claim:

1. In a toll-operated parking area, in combination with blocking means against entry of an incoming automotive vehicle thereinto, a. means for stamping the date of entry on the side-wall of a tire of the vehicle body in invisible ink, and b. means for releasing said blocking means in response to the completion of the operation of said stamping means.

2. An apparatus as set forth in claim 1, wherein said blocking means comprises a. a guide channel for the aligned front and rear wheels of a vehicle, b. a pivoted upstanding plate at the forward end of said channel, c. means for locking said plate against movement, and d. means for withdrawing said blocking means upon completion of the cycle of operation of said stamping means.

3. An apparatus as set forth in claim 2, including signalling means operating simultaneously with said last-mentioned withdrawing means to indicate the inoperative condition of the blocking means.

4. An apparatus as set forth in claim 3, including displaced positioning devices in said channel to indicate the alignment of the tire with the date-stamping means.

5. An apparatus as set forth in claim 4, including supplemental blocking means adjacent to the rear inlet of the channel to prevent a reversal of movement of the vehicle following the initiation of the cycle of operation.

6. In a toll-operated parking area, in combination with blocking means against entry of an incoming automobile vehicle thereinto, a. said blocking means comprising a guide channel for the aligned front and rear wheels of the vehicle, a pivoted upstanding plate at the forward end of said channel, and means for locking said plate against movement, b. means for stamping on the bottom portion of the side-wall of a tire of the vehicle, in invisible ink, the date of entry of the vehicle into the parking area, c. displaced positioning devices in said channel to indicate the alignment of the tire with the date-stamping means, d. means for withdrawing said blocking means and releasing said upstanding plate upon the completion of the cycle of operation of said stamping means, e. signalling means operating simultaneously with said withdrawing means to indicate the inoperative condition of said blocking means, f. supplemental blocking means adjacent to the rear inlet of said channel to prevent a reversal of movement of the vehicle following the initiation of the cycle of operation, and g. a plurality of electrical switches at displaced points along the guide channel for controlling sequentially the inking of the date stamping means with the invisible ink, the movement of the date stamp against the side-wall of the tire and said withdrawal of the locking means.

7. An apparatus as set forth in claim 6, wherein said switches comprise a photo-electric switch operated by the interruption of a light-ray when the tire is in position for the stamping of the date thereon.

8. An apparatus as set forth in claim 7, including a housing on the side of said guide channel, and electromechanical means within said housing for operating said inking and date-stamping means.

9. An apparatus as set forth in claim 8, wherein said signalling means includes lamp indicators on said housing.

10. An apparatus as set forth in claim 9, wherein said inking means comprises a reservoir for the invisible ink with a continuously operating motor for stirring the ink within the reservoir.

11. An apparatus as set forth in claim 10, including cyclically operating electric motors for inking the date stamp and for actuating the date stamp to and from the tire of the vehicle.

12. An apparatus as set forth in claim 11, wherein said electric motor for actuating the date stamp is reversible, with a reciprocating actuator geared thereto.

13. An apparatus as set forth in claim 12, including a plurality of limit switches cooperating with said actuator for controlling said reversible motor.

14. An apparatus as set forth in claim 13, wherein one of said switches is operable at the conclusion of the date-stamping operation to initiate the reversal of the motor, and a second one of said switches is operable to stop said motor at the end of the stamping operation.

15. An apparatus as set forth in claim 14, including an additional limit switch on said actuator for reversing said electric motor in response to an extended travel of said actuator without encountering a tire in its path.

* * * * *